US011459198B2

(12) United States Patent
Miyauchi et al.

(10) Patent No.: US 11,459,198 B2
(45) Date of Patent: Oct. 4, 2022

(54) MEDIUM FEEDING APPARATUS AND IMAGE READING APPARATUS

(71) Applicant: SEIKO EPSON CORPORATION, Tokyo (JP)

(72) Inventors: Keisuke. Miyauchi, Kitakyushu (JP); Kazuhiko Arimori, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 105 days.

(21) Appl. No.: 16/666,320

(22) Filed: Oct. 28, 2019

(65) Prior Publication Data

US 2020/0130972 A1 Apr. 30, 2020

(30) Foreign Application Priority Data

Oct. 26, 2018 (JP) ..... JP2018-202080

(51) Int. Cl.
*B65H 3/06* (2006.01)
*B65H 7/12* (2006.01)
(Continued)

(52) U.S. Cl.
CPC ..... *B65H 7/06* (2013.01); *B65H 3/0684* (2013.01); *B65H 43/04* (2013.01);
(Continued)

(58) Field of Classification Search
CPC .. B65H 3/0684; B65H 3/0607; B65H 3/5261; B65H 2515/704; B65H 2511/524;
(Continued)

(56) References Cited

U.S. PATENT DOCUMENTS 4,822,023 A * 4/1989 Miyoshi ..... B65H 3/56 271/118
5,129,642 A * 7/1992 Svyatsky ..... B65H 1/025 271/10.03
(Continued)

FOREIGN PATENT DOCUMENTS

JP 62218342 A * 9/1987
JP 06219600 A * 9/1994
(Continued)

*Primary Examiner* — Luis A Gonzalez
(74) *Attorney, Agent, or Firm* — Workman Nydegger

(57) ABSTRACT

A medium feeding apparatus includes a pickup roller that feeds a medium from a medium mount section. A support member supports a pickup roller and swings around a swing axis to switch between a feeding position and a non-feeding position. A separation roller separates the medium from other media. A feed roller feeds the medium toward the downstream end. The separation and feed rollers are disposed downstream of the pickup roller. A control section controls a position of the support member. After the pickup roller and the feed roller start rotating, when the control section determines that the separation roller stops rotating or returns the medium by rotating in a reverse direction, based on a detection signal from a rotation sensing section configured to detect rotation of the separation roller, the control section causes the support member to switch from the feeding position to the non-feeding position.

7 Claims, 10 Drawing Sheets

(51) Int. Cl.
*B65H 3/52* (2006.01)
*B65H 7/06* (2006.01)
*B65H 43/04* (2006.01)

(52) U.S. Cl.
CPC .... *B65H 2404/166* (2013.01); *B65H 2601/11* (2013.01); *B65H 2601/255* (2013.01)

(58) Field of Classification Search
CPC ..... B65H 2511/528; B65H 7/06; B65H 7/18; B65H 43/04; B65H 3/0669
See application file for complete search history.

(56) References Cited

U.S. PATENT DOCUMENTS 7,455,286 B2 * 11/2008 Klaffenbach ..... B65H 3/5261 271/114
7,905,484 B2 * 3/2011 Komuro ..... B65H 3/0684 271/263
8,777,220 B2 * 7/2014 Oshiro ..... B65H 7/125 271/258.01
2002/0001105 A1 1/2002 Takaki et al.
2017/0269533 A1 * 9/2017 Shoji ..... B65H 3/0669
2019/0256309 A1 * 8/2019 Shiota ..... B65H 5/062
2019/0344985 A1 * 11/2019 Aoki ..... G03G 15/553

FOREIGN PATENT DOCUMENTS

JP 10017163 A * 1/1998
JP H11-119596 4/1999
JP 2002-002977 1/2002
JP 2009137716 A * 6/2009
JP 2009-149406 7/2009
JP 2011-136811 7/2011
JP 2014-177326 9/2014
JP 2014196194 A * 10/2014
JP 2016-179870 10/2016
JP 2018-104168 7/2018

* cited by examiner

MEDIUM FEEDING APPARATUS AND IMAGE READING APPARATUS

The present application is based on, and claims priority from JP Application Serial Number 2018-202080, filed Oct. 26, 2018, the disclosure of which is hereby incorporated by reference herein in its entirety.

BACKGROUND

1. Technical Field

The present disclosure relates to a medium feeding apparatus that transports media and an image reading apparatus with this medium feeding apparatus.

2. Related Art

Most office automation (OA) machines such as scanners and printers are equipped with medium feeding apparatuses that transport media; such medium feeding apparatuses are sometimes called auto document feeders (ADFs). As an example, JP A-11-119596 discloses an ADF that includes: a mounting on which sheets or other media are mounted; a pickup roller that feeds the sheets from the mounting; and a swing arm that supports the pickup roller and swings to move the pickup roller relative to the sheets.

In the above-disclosed ADF, when uppermost and next ones of the sheets are sequentially fed from the mounting by the pickup roller, the next sheet may be stuck. Hereinafter, for convenience, the uppermost sheet is referred to as the first sheet, and the next sheet is referred to as the second sheet. When the second sheet is fed by the pickup roller, a front portion of the second sheet is curled inside the space created on a transport route under the first sheet. This curling develops as the first sheet is fed toward the downward end, and eventually the second sheet may be stuck.

To avoid the above disadvantage, when the first sheet that has been fed by the pickup roller is nipped between feed rollers disposed downstream of the pickup roller, it is preferable for the pickup roller to move swiftly away from the first sheet. To perform this operation, it is necessary to provide a sheet detector adjacent to and downstream of transport rollers. In response to the detection of the front edge of the first sheet, the pickup roller needs to move away from the first sheet. However, it takes a considerably long time until the front edge of the first sheet that has left the transport rollers reaches the sheet detector. During this time, the second sheet may be curled and then stuck.

SUMMARY

According to an aspect of the present disclosure, a medium feeding apparatus includes a medium mount section in which one or more media are mounted. A pickup roller makes contact with an upper surface of a medium mounted in the medium mount section and feeds the medium toward a downstream end. A support member that supports the pickup roller swings around a swing axis to switch between a feeding position in which the pickup roller is in contact with the medium and a non-feeding position in which the pickup roller is apart from the medium. A separation roller that is disposed downstream of the pickup roller separates the medium from other media. A feed roller is in contact with the separation roller and feeds the medium toward the downstream end. A control section controls a position of the support member. The support member is configured to switch from the feeding position to the non-feeding position by receiving power from a support member driving motor that is controlled by the control section. After both the pickup roller and the feed roller start rotating, when the control section determines that the separation roller stops rotating or returns the medium toward an upstream end by rotating in a reverse direction, based on a detection signal from a rotation sensing section configured to detect rotation of the separation roller, the control section causes the support member to switch from the feeding position to the non-feeding position.

DESCRIPTION OF EXEMPLARY EMBODIMENTS

Figure 1:
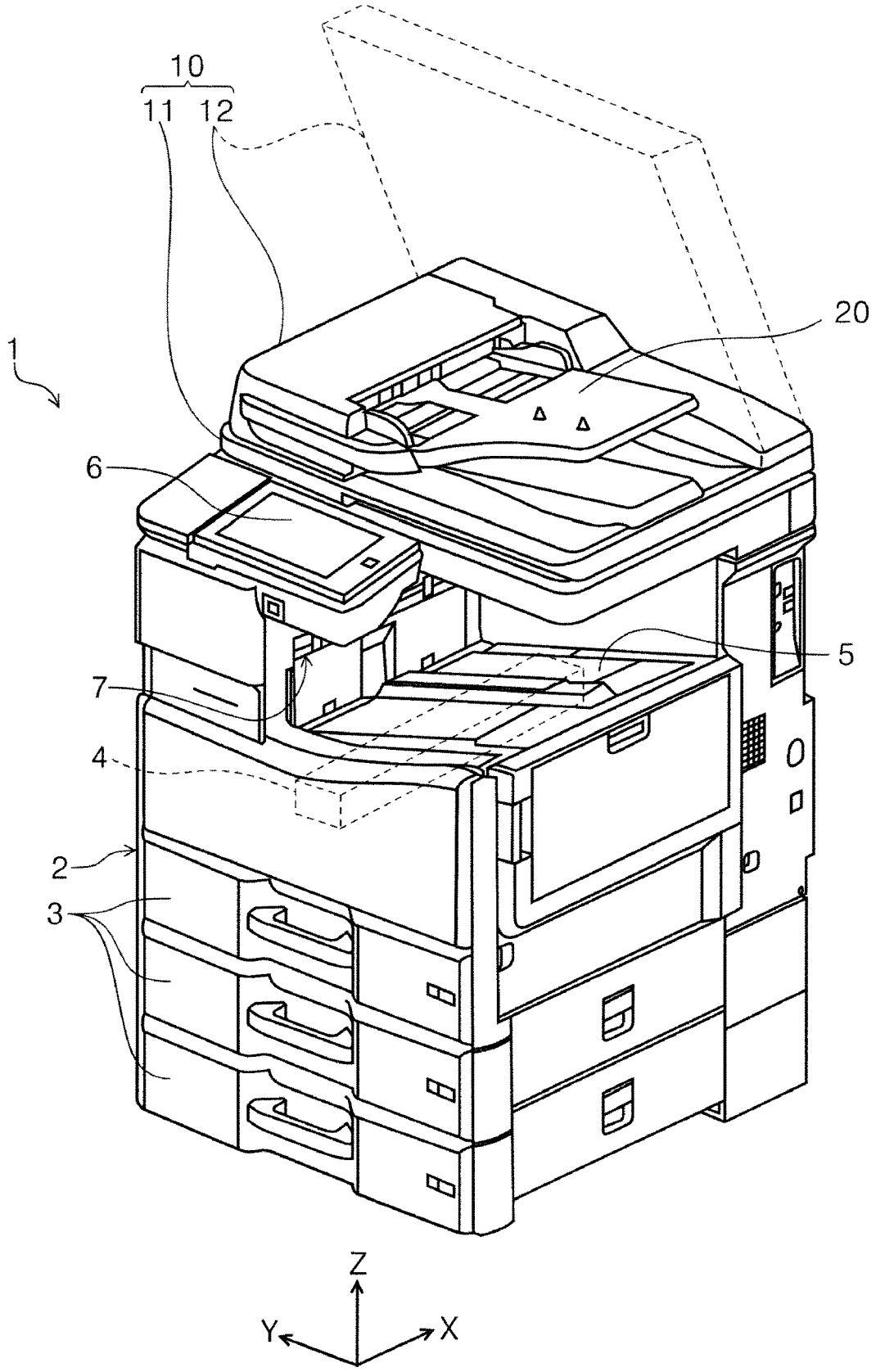
FIG. 1 is a perspective view of a medium feeding apparatus and an image reading apparatus according to a first embodiment of present disclosure.

Some aspects of the present disclosure will be described briefly below.

A medium feeding apparatus according to a first aspect of the present disclosure includes a medium mount section in which one or more media are mounted. A pickup roller makes contact with an upper surface of a medium mounted in the medium mount section and feeds the medium toward a downstream end. A support member supports the pickup roller and swings around a swing axis to switch between a feeding position in which the pickup roller is in contact with the medium and a non-feeding position in which the pickup roller is apart from the medium. A separation roller that is disposed downstream of the pickup roller separates the medium from other media. A feed roller that is in contact with the separation roller feeds the medium toward the downstream end. A control section controls a position of the support member. The support member is configured to switch from the feeding position to the non-feeding position by receiving power from a support member driving motor that is controlled by the control section. After both the pickup roller and the feed roller start rotating, when the control section determines that the separation roller stops rotating or returns the medium toward an upstream end by rotating in a reverse direction, based on a detection signal from a rotation sensing section configured to detect rotation of the separation roller, the control section causes the support member to switch from the feeding position to the non-feeding position.

When a first medium is nipped between the feed roller and the separation roller, the separation roller rotates in the forward direction. However, when a second medium is further nipped between the feed roller and the separation roller, the separation roller stops rotating or rotates in the reverse direction. This operation is utilized for the first aspect. Specifically, after both the pickup roller and the feed roller start rotating, when the separation roller stops rotating or rotates in the reverse direction, the control section causes the support member to switch from the feeding position to the non-feeding position. This configuration can shorten the period over which the pickup roller applies a feeding force to the second sheet, thereby effectively reducing the risk of the second sheet being stuck inside the medium feeding apparatus.

In addition to the configuration of the first aspect, the medium feeding apparatus according to a second aspect of the present disclosure may further include a first sensor disposed downstream of the feed roller. This first sensor may detect passage of front and rear edges of the medium. When the control section determines that the front edge of the medium passes through a location of the first sensor, based on information from the first sensor, the control section may cause the support member to switch from the feeding position to the non-feeding position, independently of rotation of the separation roller.

According to the second aspect, the control section may determine whether the front edge of the first medium passes through the location of the first sensor, based on the information from the first sensor disposed downstream of the feed roller. When determining that the front edge of the first medium passes, the control section may cause the support member to switch from the feeding position to the non-feeding position, independently of the rotation of the separation roller. This configuration can more reliably shorten the period over which the pickup roller applies the feeding force to the second medium.

A medium feeding apparatus according to a third aspect of the present disclosure includes a medium mount section in which one or more media are mounted. A pickup roller makes contact with an upper surface of a medium mounted in the medium mount section and feeds the medium toward a downstream end. A support member that supports the pickup roller swings around a swing axis to switch between a feeding position in which the pickup roller is in contact with the medium and a non-feeding position in which the pickup roller is apart from the medium. A separation roller that is disposed downstream of the pickup roller separates the medium from other media. A feed roller that is in contact with the separation roller feeds the medium toward the downstream end. A roller driving motor serves as a driving source for the feed roller. A control section controls a position of the support member. The support member is configured to switch from the feeding position to the non-feeding position by receiving power from a support member driving motor that is controlled by the control section. After both the pickup roller and the feed roller start rotating, when a driving current flowing through the roller driving motor exceeds a threshold, the control section causes the support member to switch from the feeding position to the non-feeding position.

When the front edge of a first medium is nipped between the feed roller and the separation roller, the driving current flowing through the roller driving motor, which serves as the driving source, increases. This property is utilized for the third aspect. After both the pickup roller and the feed roller start rotating, when the driving current exceeds the threshold, the control section causes the support member to switch from the feeding position to the non-feeding position. As a result, immediately before the front edge of the first medium is nipped between the feed roller and the separation roller, the control sections move the pickup roller away from the first medium. This configuration can shorten the period over which the pickup roller applies a feeding force to the second sheet, thereby effectively reducing the risk of the second sheet being stuck inside the medium feeding apparatus.

In addition to the configuration of the third aspect, the medium feeding apparatus according to a fourth aspect of the present disclosure may further include a first sensor disposed downstream of the feed roller. This first sensor may detect passage of front and rear edges of the medium. When the control section determines that the front edge of the medium passes through a location of the first sensor, based on information from the first sensor, the control section may cause the support member to switch from the feeding position to the non-feeding position, independently of the driving current.

According to the fourth aspect, the control section may determine whether the front edge of the medium passes through the location of the first sensor, based on the information from the first sensor disposed downstream of the feed roller. When determining that the front edge of the medium passes, the control section causes the support member to switch from the feeding position to the non-feeding position, independently of the driving current. This configuration can more reliably shorten the period over which the pickup roller applies the feeding force to the second medium.

In addition to the configuration of one of the first to fourth aspects, the medium feeding apparatus according to a fifth aspect of the present disclosure may further include an inclined surface disposed between the pickup roller and the feed roller. The front edge of the medium fed from the medium mount section may make contact with the inclined surface, and space may be created between the inclined surface and an uppermost one of the media fed from the medium mount section by the pickup roller.

According to the fifth aspect, the inclined surface may be disposed between the pickup roller and the feed roller. The front edge of the medium fed from the medium mount section may make contact with this inclined surface. Between the inclined surface and the uppermost medium fed from the medium mount section by the pickup roller may be the space in which the next medium that has been fed subsequent to the uppermost medium might be curled and stuck. However, the function and effect of the second aspect successfully reduce the risk of the next medium being stuck inside the medium feeding apparatus.

In addition to the configuration of one of the first to fifth aspects, the medium feeding apparatus according to the sixth aspect of the present disclosure may have a configuration in which, when all the media are completely fed from the medium mount section, the control section causes the support member to switch to the non-feeding position.

According to the sixth aspect, when all the media are completely fed from the medium mount section, the control section may cause the support member to switch to the non-feeding position. This configuration successfully reduces the risk of the pickup roller inhibiting a user from placing a medium on the medium mount section, thereby providing good handleability for the user.

An image reading apparatus according to a seventh aspect of the present disclosure includes: a reader that scans the media; and a medium feeding apparatus according to one of the first to sixth aspects which feeds the media to a location at which the reader scans the media.

According to the seventh aspect, the image reading apparatus produces substantially the same effects as the medium feeding apparatus according to any of the first to sixth aspects.

Hereinafter, first and second embodiments of the present disclosure will be described in detail. Specifically, a medium feeding apparatus and an image reading apparatus with this medium feeding apparatus will be described with reference to the accompanying drawings. A scanner 10 is an example of the image reading apparatus. Each individual drawing has an X-Y-Z coordinate system in which the X-axis extends along the width of a medium to be transported in a multi-function peripheral (MFP) 1, the Z-axis extends along the height of the MFP 1 and corresponds to a vertical axis, and the Y-axis extends perpendicularly to both the X and Y axes. The front panel of the MFP 1 is oriented toward the −X side, whereas the rear panel is oriented toward the +X side.

First Embodiment

Figure 2:
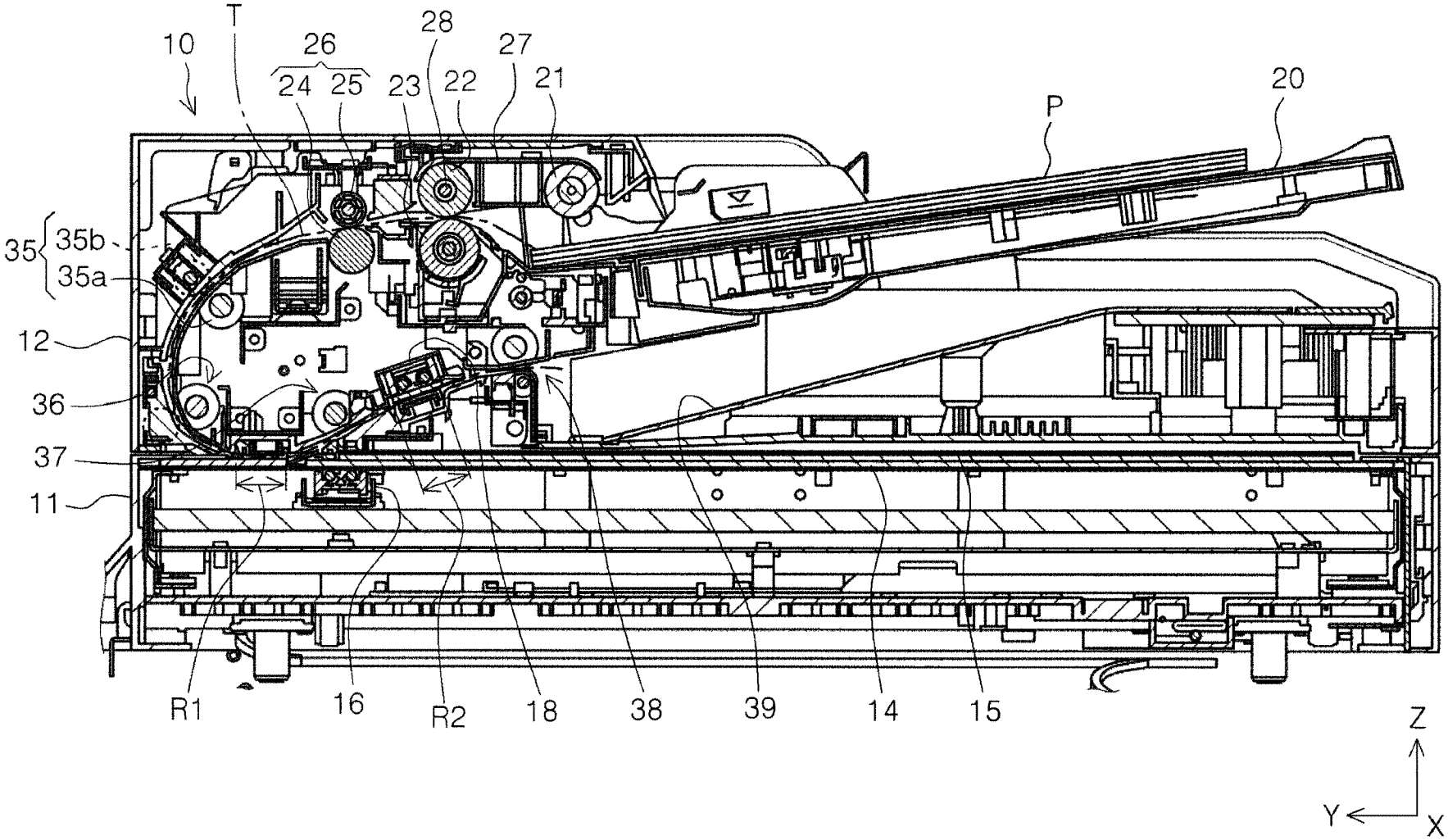
FIG. 2 is a cross-sectional side view of the medium feeding apparatus and the image reading apparatus.

As illustrated in FIG. 1, the scanner 10 is installed over the recording unit 2 and incorporated into the MFP 1 that reads an image on a medium and records the image. As illustrated in FIG. 2, the scanner 10 includes a scanner body 11 and a medium feeding apparatus 12. The scanner body 11 has a reader 16 that scans a medium mounted on a sheet mount 14. The medium feeding apparatus 12 transports one or more media from a feed tray 20 to the reader 16. Hereinafter, the media to be transported by the medium feeding apparatus 12 is referred to as the sheets P.

The medium feeding apparatus 12 can switch between a closed position and an open position. In the closed position, the medium feeding apparatus 12 covers the scanner body 11, as indicated by the solid line in FIG. 1. In the open position, the medium feeding apparatus 12 exposes the scanner body 11, as indicated by the dotted line in FIG. 1. The medium feeding apparatus 12 is provided so as to be pivotable around a shaft disposed at the edge of the scanner body 11 on the +X side and relative to the scanner body 11.

The front panel of the MFP 1 has an operation section 6 with a display unit such as a liquid crystal panel. A user can operate the operation section 6 to enter an instruction in the MFP 1 which causes the recording unit 2 to perform a recording operation or causes the scanner 10 to perform an image reading operation.

The recording unit 2 in the MFP 1 has a plurality of sheet cassettes 3 in its lower portion; each of the sheet cassettes 3 accommodates one or more recording sheets. The recording unit 2 contains a recording section 4 that records information on the sheets P to be transported by the medium feeding apparatus 12 and the recording sheets to be transported from the sheet cassettes 3. The sheets P and the recording sheets on which the information has been recorded are discharged to the outside via an ejection section 7. The ejection section 7 in the MFP 1 is provided between the scanner 10 and the uppermost sheet cassette 3 along the height of the MFP 1, or along the Z-axis. The sheets P and the recording sheets discharged via the ejection section 7 are supported by an ejection tray 5.

The reader 16, as illustrated in FIG. 2, in the scanner body 11 may be an optical reader with contact image sensors (CISs) or charge coupled devices (CCDs), for example. The reader 16, which is disposed under the sheet mount 14, can scan a sheet P mounted on the sheet mount 14 while moving along the Y-axis. The sheet mount 14 may be colorless, transparent glass, for example.

Under the medium feeding apparatus 12 is a pressing plate 15 that presses a sheet P against the sheet mount 14. When the medium feeding apparatus 12 is pivoted upward, the sheet mount 14 is exposed to the outside. When the sheet P is mounted on the sheet mount 14 and then the medium feeding apparatus 12 is pivoted downward, the pressing plate 15 presses the sheet P. In this case, the reader 16 can scan an image on the sheet P while moving along the Y-axis. The scanner 10 can scan not only a sheet P mounted on the sheet mount 14 but also other sheets P transported by the medium feeding apparatus 12.

In FIG. 2, an alternate long and short dashed line T denotes a medium transport route inside the medium feeding apparatus 12. The medium transport route T extends from the place where sheets P are to be fed by a pick roller 21 to the ejection tray 39. Herein, the pick roller 21 corresponds to a pickup roller.

As illustrated in FIG. 2, a sheet P to be transported by the medium feeding apparatus 12 are mounted on the feed tray 20. Herein, the feed tray 20 corresponds to a medium mount section on which a sheet P to be transported is mounted. Then, the pick roller 21 feeds the sheet P from the feed tray 20. The pick roller 21 is disposed on the +Y side of the sheet P mounted on the feed tray 20, namely, opposite the front edge of the sheet P in the transport direction. Downstream of the pick roller 21 in the transport direction, namely, on the +Y side of the pick roller 21 are a pair of feed rollers 22. In other words, the pick roller 21 is disposed upstream of the feed rollers 22 in the transport direction.

The pick roller 21 is movable to or away from the sheet P. When a plurality of sheets P are mounted on the feed tray 20, the pick roller 21 makes contact with the upper surface of the uppermost one of the sheets P while rotating, thereby feeding the uppermost sheet P to the feed rollers 22. The pick roller 21 rotates by receiving the power transmitted from a first motor 63 (see FIG. 3). Herein, the first motor 63 corresponds to a roller driving motor.

The pick roller 21 is attached to a support member 27, which shares the same axis with the feed rollers 22 and swings around this axis. Further, the support member 27 swings around a shaft 28 while supporting the pick roller 21, thereby switching between a feeding position and a non-feeding position. Herein, the shaft 28 corresponds to a swing axis. In the feeding position, the pick roller 21 is in contact with the sheet P, whereas in the non-feeding position, the pick roller 21 is apart from the sheet P. For example, the non-feeding position of the support member 27 may be a position, referred to below as a reference position, at which the pick roller 21 is farthest apart from the sheet P or any other position. The support member 27 switches between the feeding and non-feeding positions by receiving the power transmitted from a fourth motor 66 (see FIG. 3). Herein, the fourth motor 66 corresponds to a support member driving motor. Details of the mechanism for driving the support member 27 will be described later.

The feed rollers 22, which are disposed downstream of the pick roller 21, receive the sheet P from the pick roller 21 and feeds the sheet P toward the downstream end. The feed rollers 22 rotate by receiving the power transmitted from the first motor 63 (see FIG. 3).

Directly below the feed rollers 22 is a separation roller 23, which receives a rotational torque from a second motor 64 (FIG. 3) and is given a predetermined rotational resistance by an unillustrated torque limiter. When the feed rollers 22 feed sheets P, the separation roller 23 rotates in the reverse direction (in the clockwise direction in the page of FIG. 2) by receiving the rotational torque generated by the second motor 64 (see FIG. 3) so as to return the sheets P toward the upstream end. However, if no or a single sheet P is present between each feed roller 22 and the separation roller 23, the separation roller 23 rotates in the forward direction (in the counterclockwise direction in the page of FIG. 2) against the rotational torque, due to the behavior of the torque limiter, so as to feed the sheets P toward the downstream end.

When a first sheet P1 and a second sheet P2 (see FIG. 4) sequentially enter into between each feed roller 22 and the separation roller 23, the separation roller 23 rotates in the reverse direction by means of the rotational torque, thereby suppressing the entrance of the second sheet. It should be noted that the separation roller 23 does not necessarily have to continue rotating when the second sheet P2 enters into between each feed roller 22 and the separation roller 23. Alternatively, the separation roller 23 may repeatedly stop rotating and rotate in the reverse direction as appropriate or may slightly rotate in the forward direction.

Downstream of the feed rollers 22 and the separation roller 23 in the transport direction is a speed-up roller pair 26. Herein, the speed-up roller pair 26 corresponds to a first feed roller pair. The speed-up roller pair 26 includes: a speed-up driving roller 24 that rotates by receiving the power transmitted from the second motor 64 (see FIG. 3); and a speed-up driven roller 25 that is rotated by the rotation of the speed-up driving roller 24. The speed-up roller pair 26 feeds the sheet P toward the downstream end.

As illustrated in FIG. 2, the medium transport route T is curved downward at the location downstream of the speed-up roller pair 26. The speed-up roller pair 26 feeds the sheet P to a resist roller pair 35. Herein, the resist roller pair 35 corresponds to a second feed roller pair. The resist roller pair 35 includes: a driving roller 35*a*; and a driven roller 35*b* that is rotated by the rotation of the driving roller 35*a*. The resist roller pair 35 and other downstream rollers rotate by receiving the power transmitted from a third motor 65 (see FIG. 3).

Downstream of the resist roller pair 35 is a transport roller pair 36. When both the resist roller pair 35 and the transport roller pair 36 transport the sheet P along the medium transport route T, the sheet P is turned over and then reaches a read region R1 on the medium transport route T. The read region R1 on the medium transport route T may be made of a transparent member, such as glass, that faces the scanner body 11. When the sheet P passes through the read region R1, the reader 16 in the scanner body 11 scans the lower surface of the sheet P. Although the reader 16 is shifted from the read region R1 along the Y-axis in FIG. 2, the reader 16 moves to a location related to the read region R1 when scanning the lower surface of the sheet P transported by the medium feeding apparatus 12.

Downstream the read region R1 on the medium transport route T and above the medium transport route T is an upper-side reader 18. The sheet P that has been scanned by the reader 16 is fed to the upper-side reader 18 by a transport roller pair 37. When the sheet P passes through a read region R2 on the medium transport route T, the upper-side reader 18 scans the upper surface of the sheet P. In this way, the reader 16 and the upper-side reader 18 scan the respective surfaces of the sheet P.

After the upper-side reader 18 has scanned the sheet P, an ejection roller pair 38 discharges the sheet P to the ejection tray 39. The ejection tray 39 receives the sheet P discharged by the ejection roller pair 38 and holds the sheet P in an inclined position.

Figure 3:
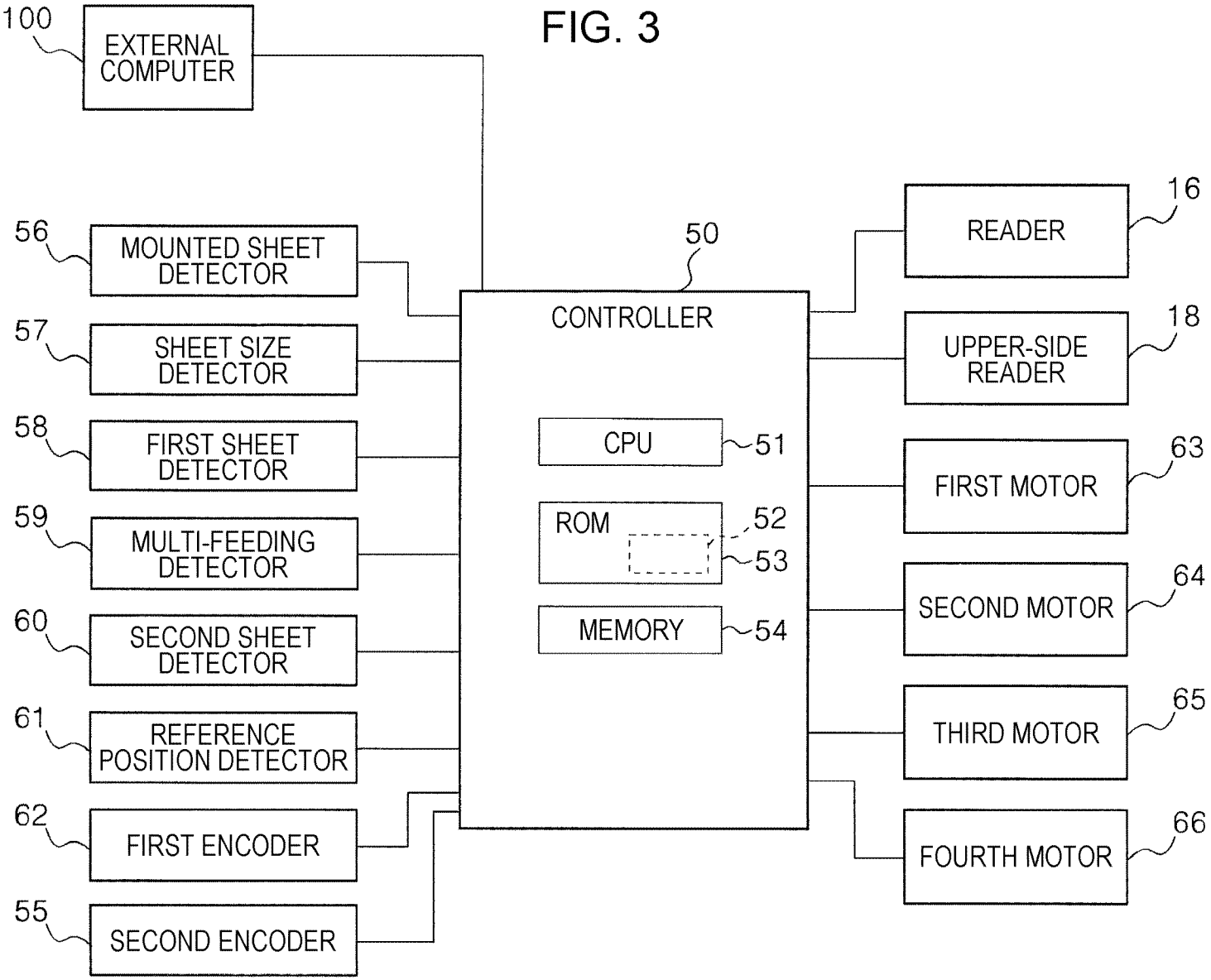
FIG. 3 is a block diagram of a control system in the medium feeding apparatus and the image reading apparatus.

Referring to FIG. 3, a control system in the scanner 10 will be described below. FIG. 3 is a block diagram of the control system in the scanner 10. A controller 50 controls various operations of the scanner 10, including feeding and scanning of sheets P. Herein, the controller 50 corresponds to a control section. The controller 50 receives a signal from the operation section 6 or transmits a signal to the operation section 6 which are used to display information in the operation section 6 or to implement a user interface (UI).

The controller 50 controls operations of the driving sources: the first motor 63, the second motor 64, the third motor 65, and the fourth motor 66, all of which may be direct current (DC) motors. As described above, the first motor 63 is a driving source for the pick roller 21 and the feed rollers 22; the second motor 64 is a driving source for the separation roller 23 and the speed-up driving roller 24; the third motor 65 is a driving source for the resist roller pair 35 and other downstream feed rollers; and the fourth motor 66 is a driving source that causes the support member 27 supporting the pick roller 21 to switch from the feeding position to the non-feeding position. In addition, the first motor 63 is also a driving source that causes the support member 27 to switch from the non-feeding position to the feeding position.

The controller 50 receives scan data from the reader 16 and the upper-side reader 18 or transmits control signals to the reader 16 and the upper-side reader 18. Furthermore, the controller 50 receives detection signals from detection sections: a mounted sheet detector 56, a sheet size detector 57, a first sheet detector 58, a multi-feeding detector 59, a second sheet detector 60, a reference position detector 61, a first encoder 62, and a second encoder 55. Based on these received detection signals, the controller 50 performs necessary operations. The control system may further include an encoder (not illustrated in FIG. 3) that detects rotations of the first motor 63 and the second motor 64.

The mounted sheet detector 56 detects presence of a sheet P on the feed tray 20. The sheet size detector 57 detects a size of the sheet P. Both of the mounted sheet detector 56 and the sheet size detector 57 are mounted on the feed tray 20. The sheet size detector 57 may include a plurality of unillustrated sensors: optical sensors arranged at predetermined spacings in the medium transport route T and along the width of the sheet P. Each optical sensor in the sheet size detector 57 outputs a detection signal that varies when it is covered with the sheet P. The controller 50 determines a size of the sheet P mounted on the feed tray 20, based on the combination of the detection signals from the optical sensors.

Figure 4:
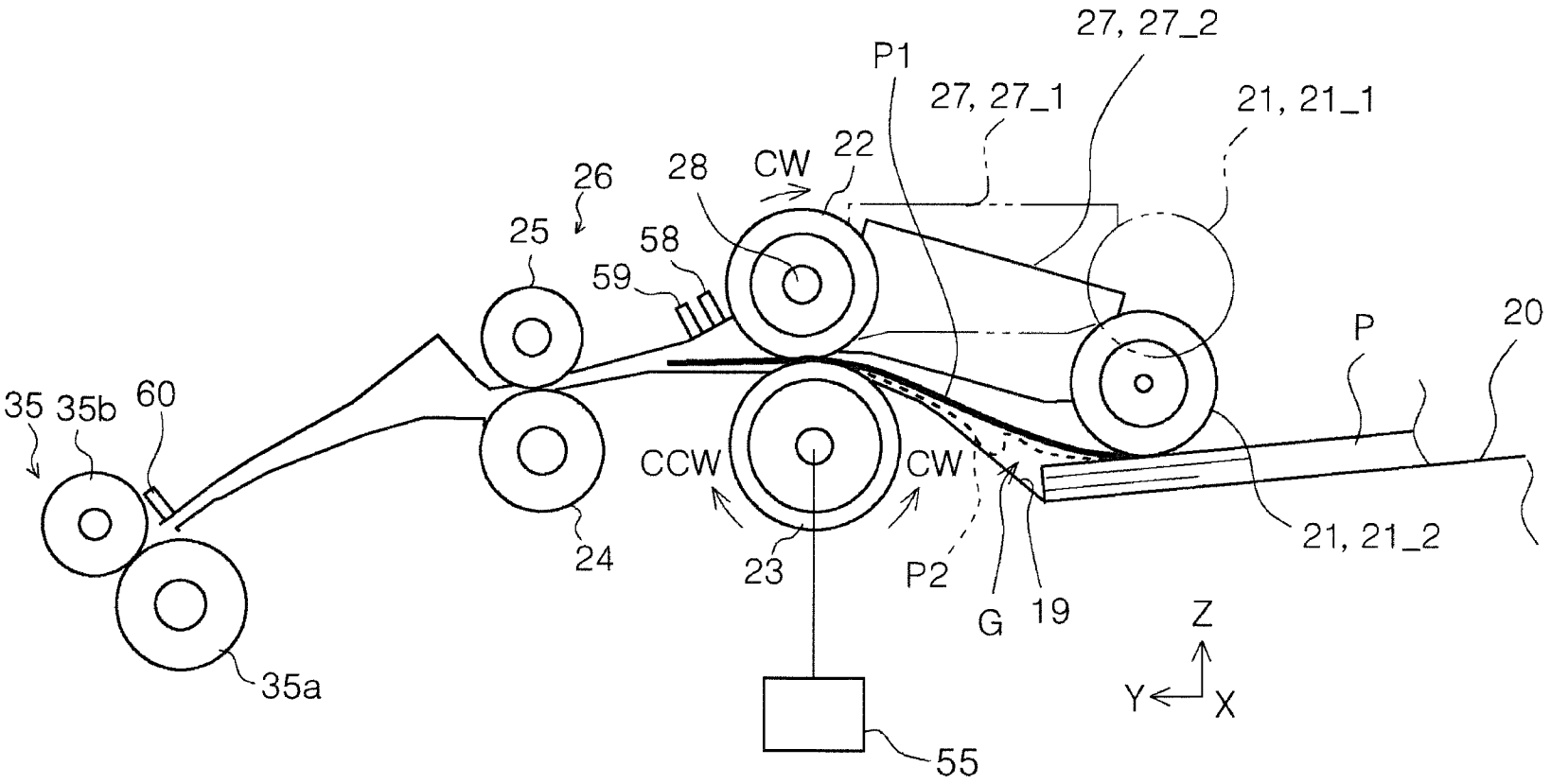
FIG. 4 is a partly enlarged, cross-sectional side view of the medium transport route in the medium feeding apparatus.

The first sheet detector 58, the multi-feeding detector 59, and the second sheet detector 60 are each disposed at predetermined locations, for example, as illustrated in FIG. 4. The first sheet detector 58 is disposed downstream of and adjacent to the feed rollers 22 and the separation roller 23. The controller 50 determines whether the front and back edges of the sheet P pass through the location of the first sheet detector 58, which may be optical sensors, based on a varying detection signal from the first sheet detector 58.

The multi-feeding detector 59 is disposed downstream of and adjacent to the first sheet detector 58. The multi-feeding detector 59 includes unillustrated ultrasonic wave transmitter and receiver that face each other with the medium transport route T therebetween. The ultrasonic wave transmitter transmits an ultrasonic wave to the ultrasonic wave receiver, and the ultrasonic wave receiver receives this ultrasonic wave and transmits an electric signal to the controller 50 in accordance with the intensity of the received ultrasonic wave. When the multi-feeding of sheets P occurs or when the thickness of the sheets P varies, the electric signal that the ultrasonic wave receiver transmits to the controller 50 changes. In this way, the controller 50 can determine that the multi-feeding of the sheets P occurs or that the thickness of the sheets P varies. The second sheet detector 60 is disposed upstream of and adjacent to the resist roller pair 35. The second sheet detector 60, which may be an optical sensor, senses the passage of the front or rear edge of the sheet P and transmits a detection signal to the controller 50. In this way, the controller 50 can determine whether the front and rear edges of the sheet P pass through the location of the second sheet detector 60.

Figure 5:
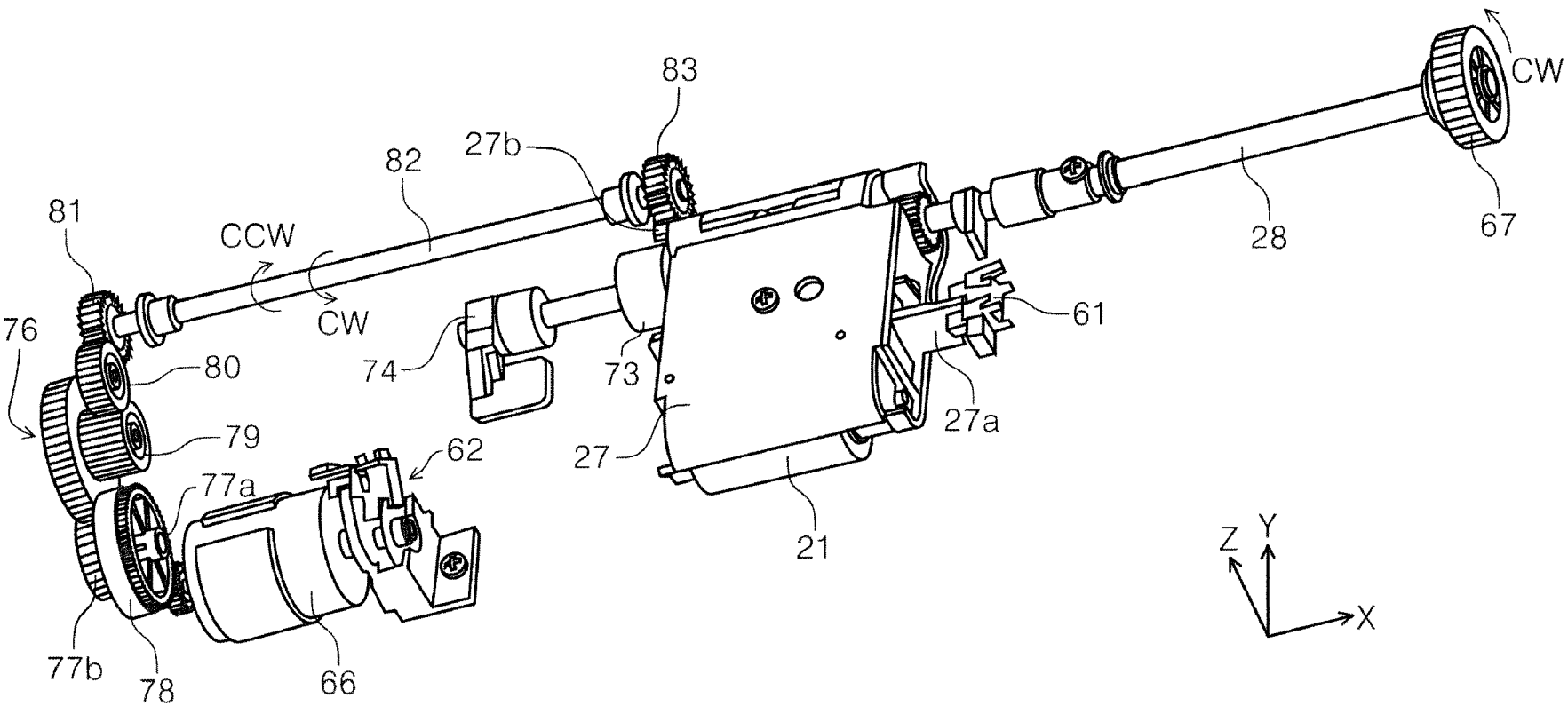
FIG. 5 is a perspective view of the mechanism for driving the support member and the pick roller.
Figure 6:
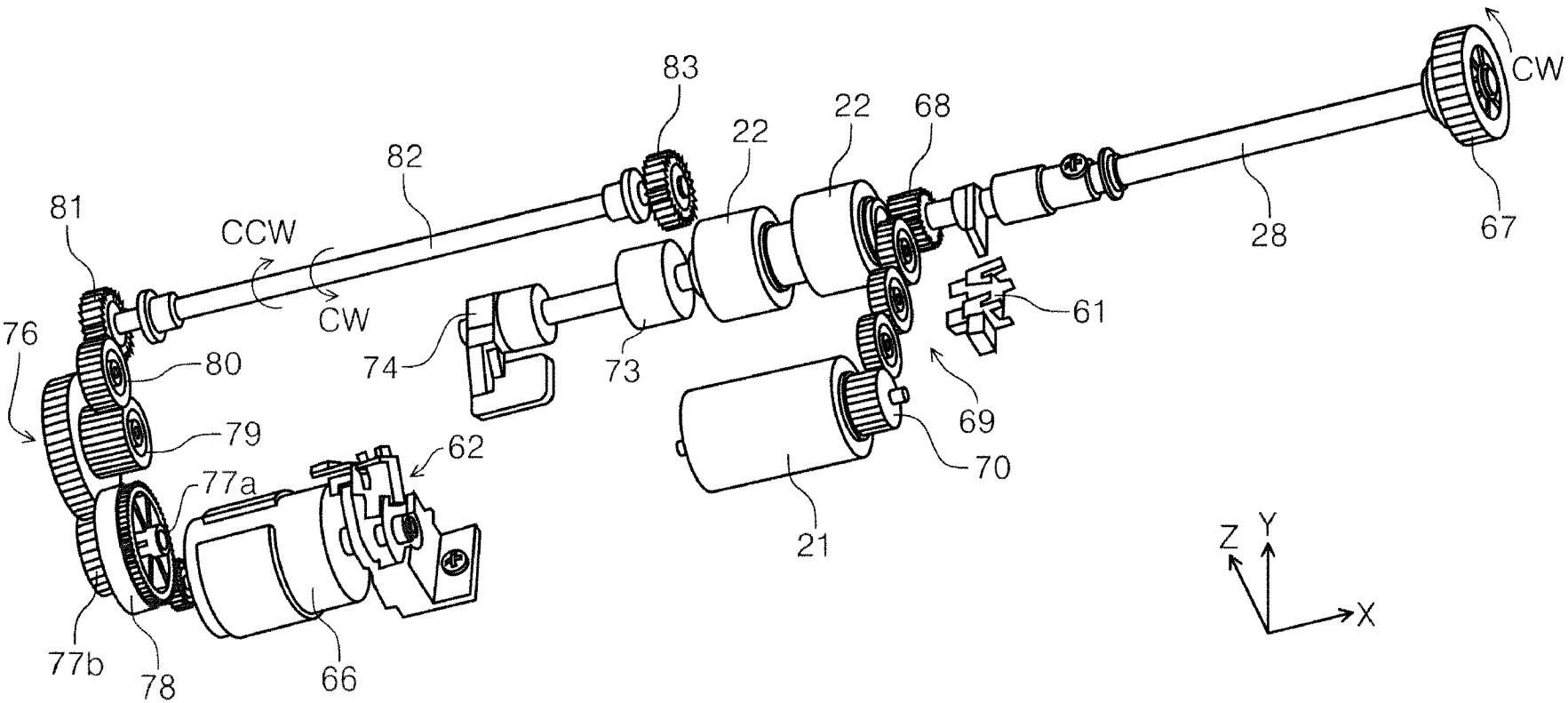
FIG. 6 is another perspective view of the mechanism for driving the support member and the pick roller.

The reference position detector 61 senses that the support member 27 is disposed at the highest position (indicated by the alternate long and two short dashes line and denoted by the reference number 27_1 in FIG. 4). In other words, the reference position detector 61 senses that the support member 27 is in the reference position. Based on a varying detection signal from the reference position detector 61, the controller 50 determines whether the support member 27 is in the reference position. The reference position is one example of the non-feeding position in which the pick roller 21 is apart from the sheet P. As illustrated in FIG. 5, the support member 27 has a detected section 27*a*. When the support member 27 is in the reference position, the detected section 27*a* blocks light from entering into the reference position detector 61, as illustrated in FIG. 5. In this way, the controller 50 can determine that the support member 27 is in the reference position.

As illustrated in FIG. 5, the first encoder 62 that senses the rotation of the fourth motor 66 is coupled directly to the fourth motor 66. Based on a pulse signal from the first encoder 62, the controller 50 can determine an amount and direction in which the fourth motor 66 rotates, in other words, an amount in which the support member 27 swings and a position of the support member 27.

The second encoder 55 that detects the rotation of the separation roller 23 has an unillustrated rotary table that is rotated in response to the rotation of the separation roller 23. Based on a pulse signal from the second encoder 55, the controller 50 can determine whether the separation roller 23 rotates. If the separation roller 23 rotates, the controller 50 also determines a rotation amount and direction of the separation roller 23.

Referring to FIG. 3 again, the controller 50 includes a central processing unit (CPU) 51, read only memory (ROM) 53, and a memory 54. The CPU 51 controls an entire operation of the scanner 10. Further, the CPU 51 performs various arithmetic processes by executing programs 52 stored in the ROM 53. The memory 54, which is an example of a storage unit, stores data required for various control. As an example, the memory 54 may be a nonvolatile memory into which data can be written or from which data can be read. As appropriate, the controller 50 may write predetermined data into the memory 54.

When the scanner 10 is connected to an external computer 100, the controller 50 can receive information from the external computer 100. Based on the information from the external computer 100, the controller 50 performs necessary control.

With reference to FIGS. 5 to 8, a description will be given below of a process of controlling feeding of sheets P. First, with reference to FIGS. 5 and 6, a description will be given below of a mechanism for driving the pick roller 21 and swinging the support member 27. The support member 27 is coupled to the swing axis, or the shaft 28, that has a first end provided with a pinion 67. The pinion 67 rotates by receiving the power transmitted from the first motor 63 (see FIG. 3) via an unillustrated pinion group, and the shaft 28 thereby rotates.

The power generated by the first motor 63 is transmitted to a pinion 70 via a pinion 68 provided on the shaft 28 and a pinion group 69. When the pinion 70 rotates, the pick roller 21 also rotates, because both the pinion 70 and the pick roller 21 share the same axis. Both the pinion group 69 and the pinion 70 are provided in the support member 27. A second end of the shaft 28 opposite the first end provided with the pinion 67 is supported by a bearing member 74.

The shaft 28 is provided with a torque limiter 73 via which the rotational torque of the shaft 28 is transmitted to the support member 27. When the first motor 63 rotates, the pinion 67 rotates in the direction indicated by an arrow CW in FIG. 6. In response to this, the support member 27 swings in the same direction, thereby lowering the pick roller 21 toward a sheet P mounted on the feed tray 20. As a result, the support member 27 switches from the reference position to the feeding position. When the pick roller 21 makes contact with the sheet P, the shaft 28 rotates at idle independently of the rotation of the support member 27 due to the behavior of the torque limiter 73. The torque limiter 73 is provided at the most upstream location on the route along which the first motor 63 transmits its torque to the support member 27 via the shaft 28. Further, the torque limiter 73 is disposed directly on the shaft 28. This arrangement successfully reduces fluctuations of the torque transmitted from the first motor 63, thereby bringing the pick roller 21 into contact with the sheet P at a stable load.

When both the pinion 67 and the shaft 28 rotate in conjunction with each other in the direction indicated by the arrow CW, the feed rollers 22 provided on the shaft 28 and the pick roller 21 rotate together clockwise in the page of FIG. 4, thereby feeding the sheet P toward the downstream end. Between the shaft 28 and the feed rollers 22 is an unillustrated one-way clutch, which causes the feed rollers 22 to rotate at idle clockwise in the page of FIG. 4 when the shaft 28 stops rotating.

The support member 27 is provided with a pinion section 27*b*, which engages with a pinion 83. When the pinion 83 rotates, the support member 27 switches from the feeding position to the non-feeding position. The pinion 83 is provided at a first end of a shaft 82, and a second end of the shaft 82 opposite the first end is provided with a pinion 81, to which the power generated by the fourth motor 66 is transmitted via a power transmission mechanism 76. The power transmission mechanism 76 includes a belt 78, a pulley 77*a*, a pinion 77*b*, a complex pinion 79, and a pinion 80. Both the pulley 77*a* and the pinion 77*b* are integrated with each other. With this arrangement, when the fourth motor 66 rotates to rotate the shaft 82 in the direction indicated by the arrow CW, the support member 27 switches from the feeding position to the non-feeding position.

The pinion 81 has an unillustrated one-way clutch that allows the shaft 82 to rotate at idle in the direction indicated by an arrow CCW when the pinion 81 stops rotating. In this case, when the support member 27 is lifted up, the torque generated by the fourth motor 66 does not act on the support member 27. Therefore, even if a sheet P is stuck inside the medium feeding apparatus 12, a user can easily remove the sheet P by lifting up the support member 27.

Next, with reference to FIG. 4, a description will be given below of an event in which, when both the first sheet P1 and the second sheet P2 are transported by the above configuration, the second sheet P2 is stuck inside. When the pick roller 21 feeds the first sheet P1 toward the downstream end, the first sheet P1 moves toward the feed rollers 22 with its front portion being in contact with an inclined surface 19 disposed on the medium transport route T and then is nipped between each feed roller 22 and the separation roller 23. In which case, created between the first sheet P1 and the inclined surface 19 is space G in which a front portion of the second sheet P2 is curled. This curling develops as the first sheet P1 moves toward the downstream end, and eventually the second sheet P2 may be stuck. To avoid this disadvantage, immediately after the first sheet P1 fed by the pick roller 21 has been nipped between each feed roller 22 and the separation roller 23, the support member 27 preferably switches from the feeding position to the non-feeding position, in other words, moves the pick roller 21 away from the first sheet P1. Therefore, in response to the detection of the front edge of the first sheet P1 with the first sheet detector 58 disposed downstream of the feed rollers 22, the support member 27 switches from the feeding position to the non-feeding position. However, it takes a considerably long time until the front edge of the first sheet P1 reaches the first sheet detector 58. During this time, the second sheet P2 may be curled and then stuck.

To avoid the above disadvantage, the second encoder 55 that detects the rotation of the separation roller 23 is provided in this embodiment. Based on a detection signal from the second encoder 55, the controller 50 causes the support member 27 from the feeding position to the non-feeding position. Details of this operation will be described below with reference to FIG. 7.

Before the scanner 10 starts to execute a job for scanning sheets P, the reference position detector 61 outputs a signal in an ON state. This means that the support member 27 is in the reference position (denoted by the reference numeral 27_1 in FIG. 4). In other words, the pick roller 21 is farthest apart from the sheet P (or in the position denoted by the reference numeral 21_1 in FIG. 4). All of the first motor 63 to the fourth motor 66 are in the OFF state, and both of the first sheet detector 58 and the second sheet detector 60 output detection signals in the OFF state, namely, in the non-detection state. Hereinafter, a process of controlling the first motor 63, the second motor 64, and the fourth motor 66 will be described, but a process of controlling the third motor 65 will not be described.

Upon the reception of an instruction to scan the sheets P, at a timing T1, the controller 50 rotates the fourth motor 66 in the direction indicated by the arrow CCW. This rotation does not cause the shaft 82 to rotate in the direction indicated by the arrow CCW (see FIG. 5), because the torque generated by the fourth motor 66 is blocked by the one-way clutch in the pinion 81. However, the rotation of the fourth motor 66 in the direction indicated by the arrow CCW allows the one-way clutch in the pinion 81 to move smoothly, so that the one-way clutch can easily perform the function.

At a timing T2, the controller 50 drives the first motor 63 to rotate the pinion 67, namely, the shaft 28 in the direction indicated by the arrow CW (see FIG. 5). The support member 27 thereby switches from the reference position to the feeding position denoted by a reference number 27_2 in FIG. 4. As a result, the pick roller 21 is set in the position denoted by a reference number 21_2 in FIG. 4 and makes contact with the first sheet P1. Simultaneously, the controller 50 drives the second motor 64, so that the pick roller 21, the feed rollers 22, and the separation roller 23 start rotating at the timing T2. In this case, neither the first sheet P1 nor the second sheet P2 reaches the feed rollers 22 and the separation roller 23. Therefore, the feed rollers 22 and the separation roller 23 rotate in the directions denoted by the arrows CW (see FIG. 4). In this case, the feed rollers 22 are rotated by the rotation of the separation roller 23.

Figure 7:
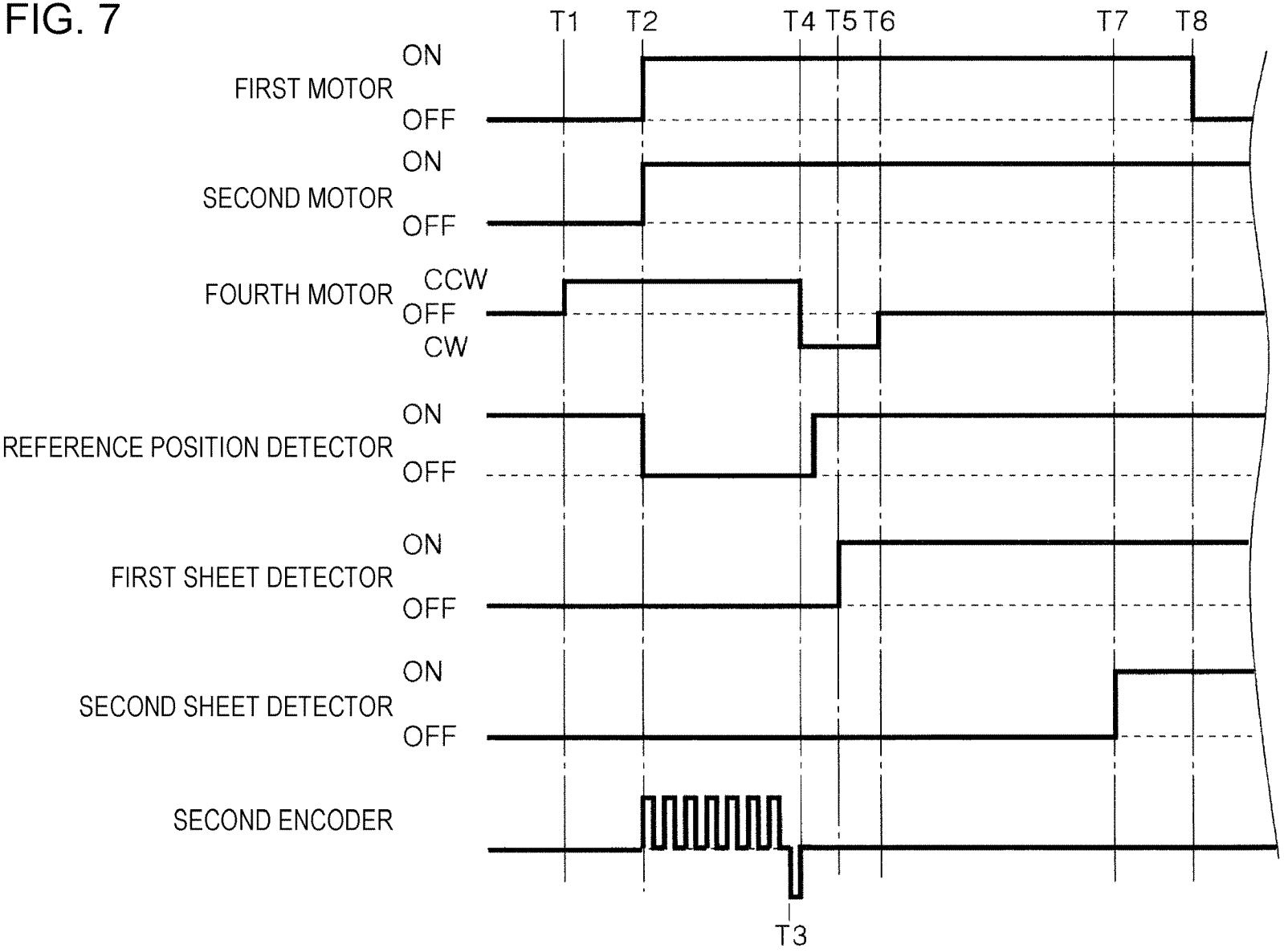
FIG. 7 is an operation timing chart in a process of controlling feeding of sheets.

The pick roller 21 rotates while making contact with the first sheet P1, thereby feeding the first sheet P1 toward the downstream end, and then the front edge of the first sheet P1 is nipped between each feed roller 22 and the separation roller 23. Even after the front edge of the first sheet P1 has been nipped between each feed roller 22 and the separation roller 23, the separation roller 23 continues to rotate in the direction denoted by the arrow CW in FIG. 4 until the second sheet P2 reaches the separation roller 23. In short, the rotation of the separation roller 23 depends on the feeding of the first sheet P1. Referring to FIG. 7, the second encoder 55 continues to output a pulse signal over the period between the timings T2 and a timing T3. This pulse signal indicates the separation roller 23 continues to rotate in the direction denoted by the arrow CW (see FIG. 4).

When the front edge of the second sheet P2 reaches the separation roller 23, the separation roller 23 starts rotating in the direction denoted by the arrow CCW in FIG. 4, as described above. At the timing T3 in FIG. 7, the pulse signal output from the second encoder 55 varies, which indicates that the separation roller 23 changes its rotational direction from the direction denoted by the arrow CW to the direction denoted by the arrow CCW (see FIG. 4). At a timing T4, the controller 50 switches the rotational direction of the fourth motor 66 to the direction denoted by the arrow CW in order to move the pick roller 21 away from the sheet P. The shaft 82 thereby rotates in the direction denoted by the arrow CW (see FIG. 5) to move the pick roller 21 away from the first sheet P1. In response, the support member 27 switches from the feeding position to the reference position. The fourth motor 66 continues to rotate in the direction denoted by the arrow CW over the period between the timing T4 and a timing T6.

At a timing T5, the front edge of the first sheet P1 reaches the first sheet detector 58. In this case, even after the first motor 63 has rotated a predetermined number of times since the timing T2 at which the first motor 63 started rotating, if the first sheet detector 58 does not detect the front edge of the first sheet P1, the controller 50 determines the first sheet P1 is stuck inside the medium feeding apparatus 12. Then, the controller 50 stops the rotation of the first motor 63 and outputs an alarm signal.

After the first sheet P1 has been further fed, at a timing T7, the front edge of the first sheet P1 reaches the second sheet detector 60. In this case, the first sheet P1 has already been nipped between the speed-up driving roller 24 and the speed-up driven roller 25 of the speed-up roller pair 26 but is not yet nipped by the driving roller 35*a* and the driven roller 35*b* of the resist roller pair 35. Therefore, at a timing T8, the controller 50 stops the rotation of the first motor 63 in order to stop the rotation of the feed rollers 22. The above control process is repeated until all the sheets P are completely transported. After all the sheets P have been completely transported, the controller 50 rotates the fourth motor 66 in the direction denoted by the arrow CW, thereby returning the support member 27 to the reference position.

Figure 8:
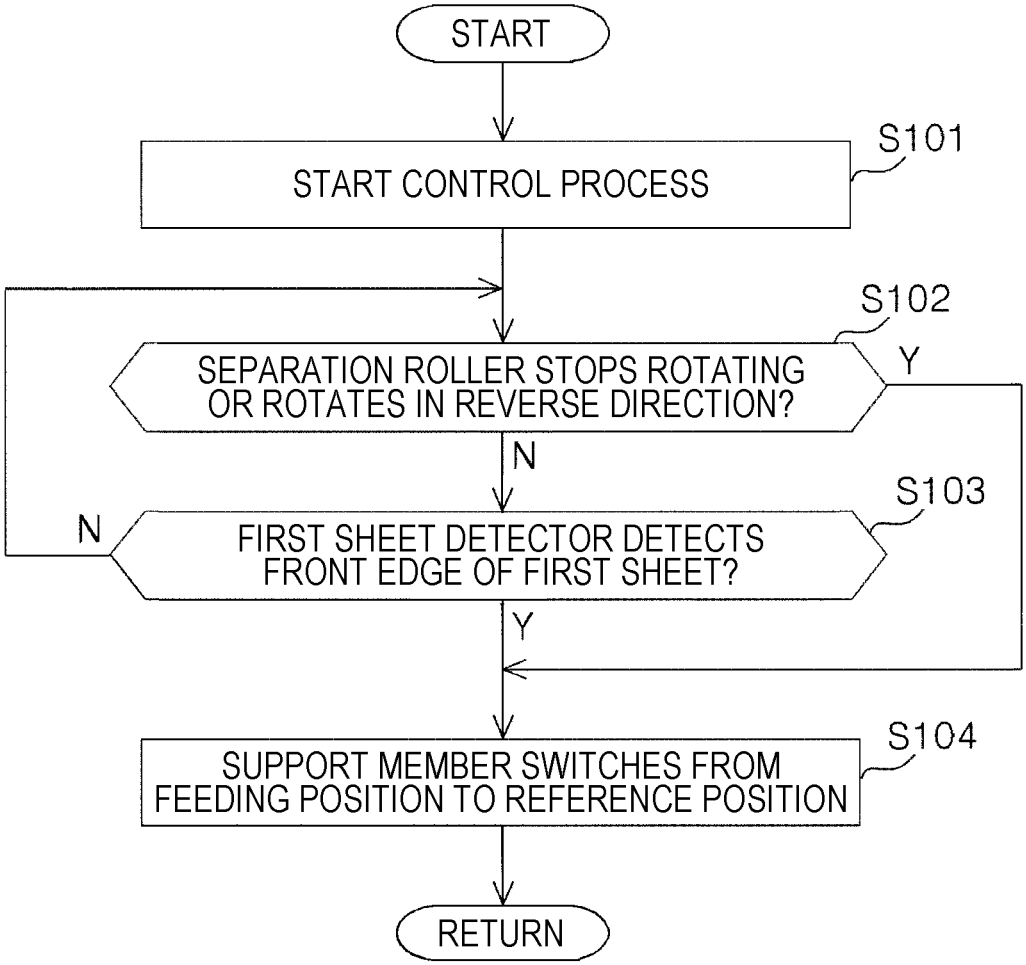
FIG. 8 is a flowchart of the control process.

Next, with reference to FIG. 8, a description will be given below of the process of controlling feeding of sheets P by using the separation roller 23. First, the controller 50 starts the control process at Step S101 and then monitors the rotation of the separation roller 23 based on the pulse signal from the second encoder 55 at Step S102. When the separation roller 23 stops rotating or rotates in the reverse direction (Y at Step S102), the controller 50 causes the support member 27 to switch from the feeding position to the reference position at Step S104. When the separation roller 23 neither stops rotating nor rotates in the reverse direction (N at Step S102) but the first sheet detector 58 detects a front edge of the first sheet P1 (Y at Step S103), the controller 50 also causes the support member 27 to switch to the reference position at Step S104.

According to the medium feeding apparatus 12 in the first embodiment, as described above, a controller 50 maintains a support member 27 in a feeding position over the period between timings T2 and T3 (see FIG. 7), in accordance with a detection signal from a second encoder 55. In this period, a pick roller 21 and feed rollers 22 rotate, and a separation roller 23 rotates in the direction denoted by an arrow CW (see FIG. 4). The second encoder 55, which is an example of a rotation sensing section herein, detects the rotation of the separation roller 23. Then, when the separation roller 23 stops rotating or rotates in the direction denoted by an arrow CCW (see FIG. 4) at a timing T4 (see FIG. 7), the controller 50 causes a support member 27 to switch from a feeding position to the non-feeding position. In this way, the controller 50 can shorten the period over which the pick roller 21 applies a feeding force to a second sheet P2, thereby effectively reducing the risk of the second sheet P2 being stuck inside the medium feeding apparatus 12 (see FIG. 4).

The medium feeding apparatus 12 includes an inclined surface 19 between the pick roller 21 and each feed roller 22. When the pick roller 21 feeds a first sheet P1 from the feed tray 20 toward the downstream end, the front edge of the first sheet P1 makes contact with the inclined surface 19. In this case, created between the first sheet P1 and the inclined surface 19 is space G in which a front portion of the second sheet P2 may be curled. As described above, however, the controller 50 can shorten the period over which the pick roller 21 applies the feeding force to the second sheet P2. Consequently, this configuration successfully reduces the risk of the second sheet P2 being stuck inside the space G.

The medium feeding apparatus 12 employs an active-type separation system in which the power generated by a second motor 64 is transmitted to the separation roller 23 in a direction denoted by an arrow CCW (see FIG. 4). However, as an alternative example, the medium feeding apparatus 12 may employ an inactive-type separation system in which the power is not transmitted to the separation roller 23. In this system, when reaching the separation roller 23, the second sheet P2 stops moving, because the separation roller 23 does not rotate in the direction denoted by the arrow CCW (see FIG. 4). Therefore, when not receiving a pulse signal from the second encoder 55 over a predetermined period, the controller 50 may determine that the second sheet P2 reaches the separation roller 23. For example, this period may be stored in a memory 54 (FIG. 3) as a threshold.

The controller 50 does not necessarily have to cause the support member 27 to switch its position in accordance with the rotation of the separation roller 23. For example, when determining that the front edge of a first sheet P1 passes through the location of the first sheet detector 58 based on a detection signal received from the first sheet detector 58 (Y at Step S103 in FIG. 8), the controller 50 may cause the support member 27 to switch from the feeding position to the non-feeding position (Step S104 in FIG. 8). This configuration can more reliably shorten the period over which the pick roller 21 applies the feeding force to the second sheet P2.

After all sheets P have been completely transported from a feed tray 20, the controller 50 causes the support member 27 to switch from the feeding position to the non-feeding position. This configuration successfully reduces the risk of the pick roller 21 inhibiting a user from placing sheets P on the feed tray 20, thereby providing good handleability for the user.

Second Embodiment

Next, a second embodiment of the present disclosure will be described below with reference to FIGS. 9 and 10. In the foregoing first embodiment, the controller 50 monitors the rotation of the separation roller 23 in order to cause the support member 27 to switch from the feeding position to the non-feeding position. In the second embodiment, however, a controller 50 monitors a driving current flowing through a second motor 64, which serves as a driving source for feed rollers 22.

Figure 9:
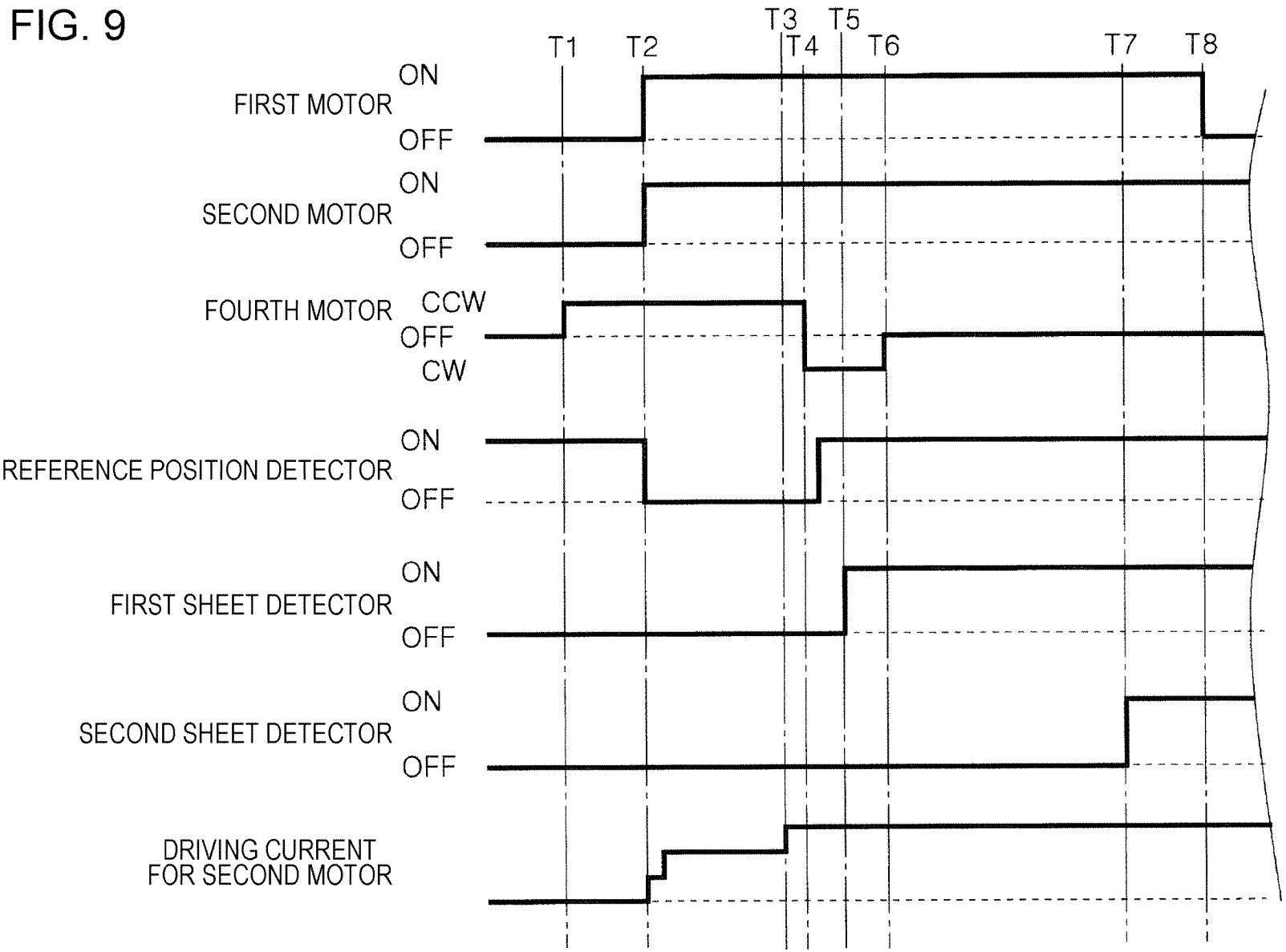
FIG. 9 is an operation timing chart in a process of controlling feeding of sheets, according to a second embodiment of the present disclosure.

FIG. 9 is a timing chart in a process of controlling feeding of sheets P in the second embodiment. FIG. 9 is identical to FIG. 7 referenced above, except for the waveform of the driving current flowing through the second motor 64. Referring to FIG. 9, when the second motor 64 starts rotating at a timing T2, the driving current increases. Then, when a pick roller 21 rotates while making contact with a first sheet P1, the driving current further increases. The pick roller 21 feeds the first sheet P1 toward the downstream end and causes a front portion of the first sheet P1 to be nipped between each feed roller 22 and the separation roller 23 at a timing T3. As a result, the driving current further increases.

The above property of the driving current is utilized for the control process in the second embodiment. When the driving current flowing through the second motor 64 exceeds a preset threshold, at a timing T4, the controller 50 causes a support member 27 from a feeding position to the non-feeding position. In short, immediately after a front portion of the first sheet P1 is nipped between each feed roller 22 and the separation roller 23, the controller 50 moves the pick roller 21 away from the first sheet P1. This configuration can shorten the period over which the pick roller 21 applies a feeding force to a second sheet P2, thereby effectively reducing the risk of the second sheet P2 being stuck inside a medium feeding apparatus 12.

Figure 10:
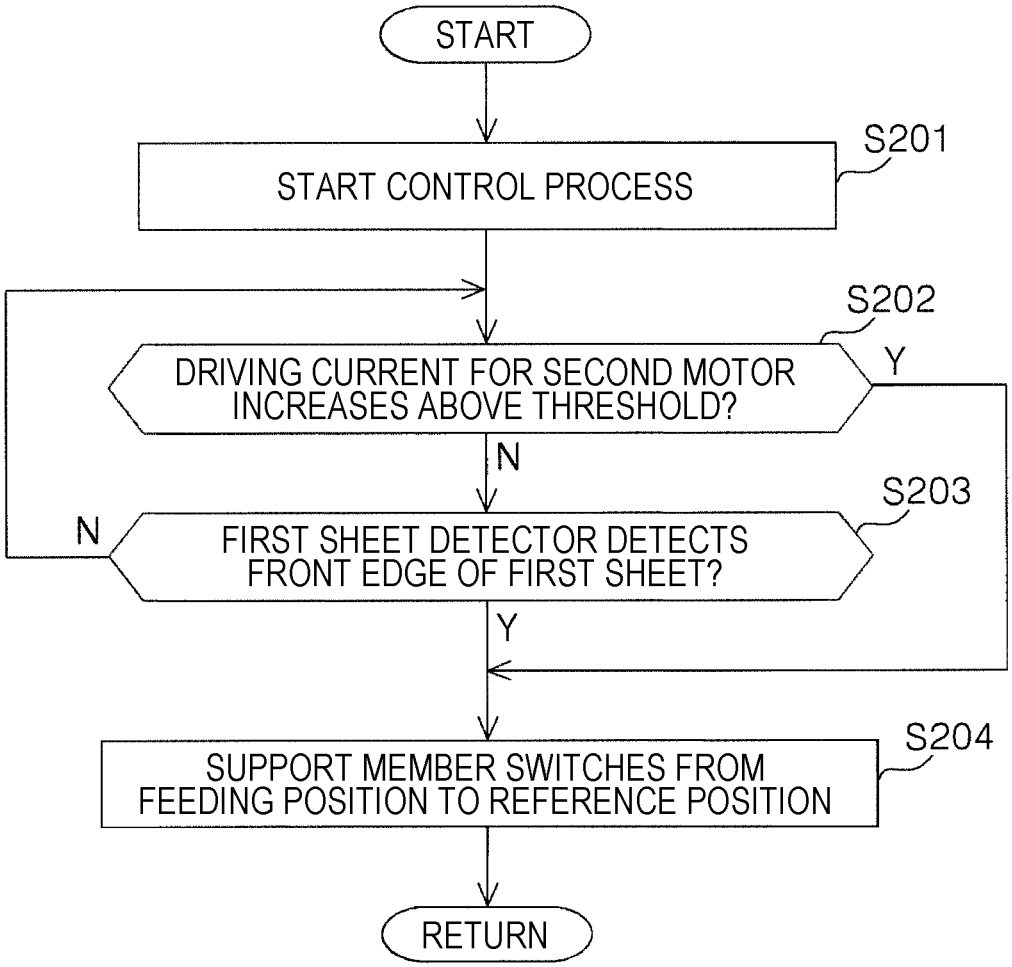
FIG. 10 is a flowchart of the control process.

Referring to FIG. 10, the controller 50 starts performing the control process at Step S201, and then monitors the driving current flowing through the second motor 64 at Step S202. When the driving current increases above the threshold (Y at Step S202), at Step S204, the controller 50 causes the support member 27 to switch from the feeding position to the reference position. When the driving current does not increase above the threshold (N at Step S202) but a first sheet detector 58 detects a front edge of the first sheet P1 (Y at Step S203), at Step S204, the controller 50 also causes the support member 27 to switch to the reference position. Performing the control process in this manner can effectively reduce the risk of the second sheet P2 being stuck inside the medium feeding apparatus 12.

The threshold for use in determining the driving current flowing through the second motor 64 may be a fixed value. However, as an alternative example, the threshold

What is claimed is:

1. A medium feeding apparatus comprising:

a medium mount section in which one or more media are mounted;

an inclined surface inclined up in a medium feeding direction, a lowest end of the inclined surface being connected to an end of the medium mount section;

a pickup roller that makes contact with an upper surface of the medium mounted in the medium mount section and feeds the medium toward a downstream end;

a support member that supports the pickup roller and that swings around a swing axis to switch between a feeding position in which the pickup roller is in contact with the medium and a non-feeding position in which the pickup roller is apart from the medium;

a separation roller that separates the medium from other media, the separation roller being disposed downstream of the pickup roller;

a feed roller that feeds the medium toward the downstream end, the feed roller being in contact with the separation roller;

a rotation sensing section configured to detect a rotational direction of the separation roller, the rotation sensing section being activated when the support member is in the feeding position, and deactivated when the support member being in the non-feeding position; and a control section that controls a position of the support member, wherein the support member is configured to switch from the feeding position to the non-feeding position by receiving power from a support member driving motor, the support member driving motor being controlled by the control section, when the support member is in the feeding position, the control section activates the rotation sensing section, and after both the pickup roller and the feed roller start rotating, in response to detecting, by the rotation sensing section, that the separation roller changes its rotational direction from the forward direction to the reverse direction that is opposite to the forward direction, the control section causes the support member to switch from the feeding position to the non-feeding position, and causes the rotation sensing section to be deactivated, and the separation roller is powered by a second motor that is different from the support member driving motor, and when both the pickup roller and the feed roller start rotating, the control section stops the second motor or causes the second motor to rotate reversely, causing the separation roller to stop rotating or rotate reversely to return the medium toward an upstream end.

2. The medium feeding apparatus according to claim 1, further comprising a first sensor that detects passage of front and rear edges of the medium, the first sensor being disposed downstream of the feed roller, wherein when the control section determines that the front edge of the medium passes through a detection location of the first sensor, based on information from the first sensor, the control section causes the support member to switch from the feeding position to the non-feeding position, independently of rotation of the separation roller.

3. The medium feeding apparatus according to claim 1, wherein the front edge of an uppermost one of the media fed from the medium mount section is in contact with the inclined surface, the inclined surface being disposed between the pickup roller and the feed roller, and a space is created between the inclined surface and the uppermost one of the media fed from the medium mount section by the pickup roller.

4. The medium feeding apparatus according to claim 1, wherein when all the media are completely fed from the medium mount section, the control section causes the support member to switch to the non-feeding position.

5. An image reading apparatus comprising:

a reader that scans media; and a medium feeding apparatus according to claim 1 which feeds the media to a location at which the reader scans the media.

6. A medium feeding apparatus comprising:

a medium mount section in which one or more media are mounted;

an inclined surface inclined up in a medium feeding direction, a lowest end of the inclined surface being connected to an end of the medium mount section;

a pickup roller that makes contact with an upper surface of the medium mounted in the medium mount section and feeds the medium toward a downstream end;

a support member that supports the pickup roller and that swings around a swing axis to switch between a feeding position in which the pickup roller is in contact with the medium and a non-feeding position in which the pickup roller is apart from the medium;

a separation roller that separates the medium from other media, the separation roller being disposed downstream of the pickup roller;

a feed roller that feeds the medium toward the downstream end, the feed roller being in contact with the separation roller;

a rotation sensing section configured to detect a rotational direction of the separation roller, the rotation sensing section being activated when the support member is in the feeding position, and deactivated when the support member being in the non-feeding position;

a roller driving motor that serves as a driving source for the feed roller;

a second driving motor that serves a driving source of the separation roller; and a control section that controls a position of the support member, wherein the support member is configured to switch from the feeding position to the non-feeding position by receiving power from a support member driving motor, the support member driving motor being controlled by the control section, when the support member is in the feeding position, the control section activates the rotation sensing section, and after both the pickup roller and the feed roller start rotating, in response to detecting, by the rotation sensing section, that the separation roller changes its rotational direction from a forward direction to a reverse direction that is opposite to the forward direction, the control section causes the support member to switch from the feeding position to the non-feeding position, and causes the rotation sensing section to be deactivated, and when both the pickup roller and the feed roller start rotating, the control section stops the second driving motor or causes the second driving motor to rotate reversely, causing the separation roller to stop rotating or rotate reversely to return the medium toward an upstream end.

7. The medium feeding apparatus according to claim 6, further comprising a first sensor that detects passage of front and rear edges of the medium, the first sensor being disposed downstream of the feed roller, wherein when the control section determines that the front edge of the medium passes through a detection location of the first sensor, based on information from the first sensor, the control section causes the support member to switch from the feeding position to the non-feeding position, independently of the driving current.

* * * * *